US012332008B1

(12) United States Patent
Anderson, Jr.

(10) Patent No.: US 12,332,008 B1
(45) Date of Patent: Jun. 17, 2025

(54) FIREARM SUPPRESSOR INTEGRATED WITH HANDGUARD

(71) Applicant: Henry Anderson, Jr., Silver Spring, MD (US)

(72) Inventor: Henry Anderson, Jr., Silver Spring, MD (US)

( * ) Notice: Subject to any disclaimer, the term of this patent is extended or adjusted under 35 U.S.C. 154(b) by 0 days.

(21) Appl. No.: 18/793,793

(22) Filed: Aug. 3, 2024

Related U.S. Application Data

(60) Provisional application No. 63/558,258, filed on Feb. 27, 2024.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 2,791,155 A * 5/1957 Thiel ..... F41C 23/06 42/1.06
3,677,132 A * 7/1972 Plenge ..... F41A 35/02 89/31
7,789,008 B2 * 9/2010 Petersen ..... F41A 21/30 89/14.4
9,879,933 B2 * 1/2018 Myers ..... F41A 21/48
10,684,088 B2 6/2020 Lo
10,976,126 B2 4/2021 Lo
11,054,207 B2 * 7/2021 Martin ..... F41A 21/28
11,635,271 B2 * 4/2023 Lagenbeck ..... F41C 23/16 89/14.4
11,920,883 B1 3/2024 Anderson, Jr.
2011/0297477 A1 * 12/2011 Koumbis ..... F41A 21/325 181/223
2012/0152093 A1 6/2012 Koumbis
2014/0190345 A1 * 7/2014 Daniel ..... F41A 21/325 89/193
2015/0090105 A1 * 4/2015 Pace ..... F41A 21/30 89/14.4
2017/0299291 A1 * 10/2017 Spector ..... F41A 5/26
2019/0017768 A1 * 1/2019 Thomas ..... F41A 21/30

* cited by examiner

*Primary Examiner* — Troy Chambers
*Assistant Examiner* — Benjamin S Gomberg

(57) ABSTRACT

A suppressor assembly for a firearm having a receiver and a barrel connected to the receiver which includes a tube adapted to be coupled to the receiver and which serves as the handguard for the firearm. The tube circumferentially encloses and extends along the barrel and defines ports arranged proximate to the receiver and apertures arranged near the muzzle end. Near the ports is a modulator that adjusts the openings of the ports. Coupled to the end of the tube is noise suppression tube wherein orifices to vent propellant gases and a baffle assembly is disposed. Propellant gases expand within the expansion volume and exit the suppressor through the ports, the apertures, the orifices and through the opening for the bullet in the end cap.

16 Claims, 8 Drawing Sheets

FIREARM SUPPRESSOR INTEGRATED WITH HANDGUARD

CROSS-REFERENCE TO RELATED PATENT APPLICATIONS AND U.S. PATENTS

This application claims priority to and the benefit of U.S. Provisional Patent Application No. 63/558,258, filed on Feb. 27, 2024, the contents of which are hereby incorporated-by-reference.

TECHNICAL FIELD

The present disclosure relates, generally, to a firearm. More particularly, the present disclosure pertains to an improvement to a suppressor for the firearm for reducing noise generated during firing a bullet.

BACKGROUND INFORMATION

Noise is generated when a bullet leaves a barrel of a firearm as the propulsive gases are released to atmosphere. Reduction of said noise is generally accomplished through by a suppressor mounted onto the firearm. The usual method of suppressor operation is to contain the gases that exit the muzzle of the firearm within a closed vessel with an opening for the bullet and allow the gases to expand, and then release them to atmosphere. A quieter way may be to control venting of the propellant gas through an additional plurality of ports distributed over the surface of suppressor, instead of venting all the gas through the single port for the bullet as is commonly done.

These suppressors come in various internal and external component arrangements, generally attaching to the muzzle, or may attach to the gas block, or may attach in some other manner to the firearm. Suppressors are generally fabricated from a high strength material to withstand propellant gas pressure and temperature. Providing a large suppressor expansion volume will result in lower pressures and temperatures inside the suppressor and therefore allow the use of lower strength and less costly materials such as aluminum and non-metallics.

Rifle firearms normally have a handguard projecting from the receiver to support the rifle during aiming and to protect the hand of the user from the hot barrel during firing. The instant inventor noticed the disclosed suppressor does not get too hot to grasp during firing of the rifle. This is attributed to the design of that patent and the thermodynamic cooling that occurs when the propellant gases are vented through the ports or orifices. This attribute permits the novel use of the instant patent to be used as the handguard for the firearm.

To those skilled in the art, a suppressor design which can accommodate a variety of existing commercial noise suppression technologies, such as flat or conically shaped metallic baffles or elastomeric baffles, may provide a significant advantage in the marketability of such a suppressor.

The co-linearity between axes of the suppressor and the barrel of the firearm controls the diameter of this bullet opening, i.e., with perfect co-linearity the bullet opening could be the same as the diameter of the bullet. The greater divergence between these axes, the larger the diameter required for the bullet opening in a metallic baffle to achieve un-impeded bullet exit. Co-linearity issues become more pronounced for longer suppressors. However, if the suppressor elements were of the type wherein the bullet makes its own hole, i.e., a "shoot through" baffle, then the misalignment issues between the axis of barrel and axis of the suppressor assembly become less of an issue being compensated for by the "shoot through" baffle given the hole in that baffle can be slightly off center.

The instant patent also discloses embodiments wherein the suppression elements are disposed at the end of the handguard in lieu or being attached to the muzzle of the barrel of the firearm as is the common approach. To those experienced in the art, this allows the barrel to be "free floated"; i.e. cantilevered from the receiver without any further constraints to its natural motion when the rifle is fired. Free floated barrels have been shown to produce the most accuracy.

The instant patent also discloses embodiments wherein the propellant gas flow from the port on the tube can be varied by the operator to change the performance of the suppressor in terms of being quieter versus greater temperature gain, as may be required by the operational scenario.

SUMMARY OF DISCLOSURE

A suppressor assembly for a firearm was disclosed in U.S. Pat. No. 11,920,883 granted on Mar. 5, 2024 (hereinafter denoted as the '883 Patent). This disclosure provides improvements to the embodiments of the '883 Patent while retaining those embodiments upon which the '883 Patent was granted pertinent to this disclosure. With regards to a basis for improvement embodiments of this disclosure, the '883 Patent and defines a suppressor assembly for a firearm having: a receiver and a barrel connected to the receiver; a tube having a first end adapted to be coupled to the receiver and defining at least one port arranged proximate to the first end and extending in a radial direction; wherein the tube is configured to be arranged around the barrel defining a radial gap therebetween; wherein the tube is configured to extend outwardly of the barrel in a longitudinal direction defining an axial gap there between; wherein the radial gap and the axial gap together define an expansion volume around the barrel; an end cap arranged at the second end of the tube and coupled to the tube wherein the end cap defines an outlet opening adapted to be arranged coaxially to the barrel to facilitate an exit of the bullet from the tube; wherein propellant gases generated during firing of a bullet exits a muzzle of the barrel and expand inside the expansion volume and exit the tube through the at least one port; and an adapter with a body and flange portion configured to couple the first end of the tube to the receiver.

The improvement embodiments of a suppressor assembly for a firearm are disclosed as follows.

In some additional, alternative, or selectively cumulative embodiments, the length of the tube does not extend beyond the muzzle of the barrel.

In some additional, alternative, or selectively cumulative embodiments, an expansion volume is defined by the radial gap and the length of the tube.

In some additional, alternative, or selectively cumulative embodiments, a modulator is disposed in juxtaposition to the at least one port of the tube, the adjustment of which regulates the gas flow from that at least one port or ports by incrementally adjusting the modulator that subsequently changes the flow area of that port or ports from fully closed to fully open. Thus, the performance of the suppressor can be varied from being most quiet to being hotter.

In some additional, alternative, or selective cumulative embodiment, are disposed apertures extending radially proximate to second end of the tube to vent propellant gases from the expansion volume and moderate pressures and temperatures within the expansion volume.

In some additional, alternative, or selectively cumulative embodiments, a noise suppression tube defining a first end and a second end and an inner surface and an interior surface, the first end of the noise suppression tube being connected to the second end of the tube.

In some additional, alternative, or selectively cumulative embodiments, a coupler is disposed to connect the noise suppression tube to the tube, said coupler having a hole to facilitate exit of the bullet from the tube.

In some additional, alternative, or selectively cumulative embodiments, the end cap is disposed at the second end of the noise suppression tube wherein the end cap defines an outlet opening adapted to be arranged coaxially to the noise suppression tube to facilitate an exit of the bullet and defines a posterior surface.

In some additional, alternative, or selectively cumulative embodiments, a shield baffle is disposed between the first end and second end of the noise suppression tube.

In some additional, alternative, or selectively cumulative embodiments, an auxiliary expansion chamber within the noise suppression tube is disposed between the first end of the noise suppression tube and the shield baffle.

In some additional, alternative, or selectively cumulative embodiments, a suppression chamber within the noise suppression tube is disposed between the shield baffle and the end cap.

In some additional, alternative, or selectively cumulative embodiments, orifices are disposed proximate to the first end of the noise suppression tube to vent high pressure propellant gases from the auxiliary expansion volume thus moderating peak propellant pressures and temperatures.

In some additional, alternative, or selectively cumulative embodiments, within the suppression chamber of the suppression tube is disposed an elastomeric baffle assembly without a hole for the bullet. When the rifle is fired, the bullet makes its own hole as it passes through.

In some additional, alternative, or selectively cumulative embodiments, within the suppression chamber of the suppression tube is disposed a resin impregnated fabric baffle assembly without a hole for the bullet. When the rifle is fired, the bullet makes its own hole as it passes through.

In an additional, alternative, or selective cumulative embodiment and given the thermodynamic processes within the tube in expelling propellant gases through the port(s), orifice(s) and aperture(s) the tube temperature remains low enough to allow the tube to be grasped and thereby allowing the tube to function as the handguard for the rifle.

Wherein propellant gases generated during firing of a bullet exits a muzzle of the barrel and expand inside the expansion volume and the auxiliary expansion volume and enter the suppression chamber and exit the suppressor assembly via the at least one port, the at least one aperture, the at least one orifice and the outlet opening.

In accordance with another example embodiment, a firearm with a suppressor was disclosed in the '883 Patent. This disclosure provides improvements to the embodiments of the '883 Patent while retaining those embodiments upon which the '883 Patent was granted pertinent to this disclosure. With regards to a basis for improvement embodiments of this disclosure, the '883 Patent defines a firearm with a suppressor in which is defined: a receiver and a barrel connected to the receiver; a tube having a first end adapted to be coupled to the receiver and defining at least one port arranged proximate to the first end and extending in a radial direction; wherein the tube is configured to be arranged around the barrel defining a radial gap therebetween; wherein the tube is configured to extend outwardly of the barrel in a longitudinal direction defining an axial gap there between; wherein the radial gap and the axial gap together define an expansion volume around the barrel; an end cap arranged at the second end of the tube and coupled to the tube wherein the end cap defines an outlet opening adapted to be arranged coaxially to the barrel to facilitate an exit of the bullet from the tube; wherein propellant gases generated during firing of a bullet exits a muzzle of the barrel and expand inside the expansion volume and exit the tube through the at least one port; and an adapter with a body and flange portion configured to couple the first end of the tube to the receiver.

The improvement embodiments for a firearm with a suppressor are disclosed as follows.

In some additional, alternative, or selectively cumulative embodiments, the length of the tube does not extend beyond the muzzle of the barrel.

In some additional, alternative, or selectively cumulative embodiments, an expansion volume is defined by the radial gap and the length of the tube.

In some additional, alternative, or selectively cumulative embodiments, a modulator is disposed in juxtaposition to the at least one port of the tube, the adjustment of which regulates the gas flow from that at least one port or ports by incrementally adjusting the modulator that subsequently changes the flow area of that port or ports from fully closed to fully open. Thus, the performance of the suppressor can be varied from being most quiet to being hotter.

In some additional, alternative, or selective cumulative embodiment, are disposed apertures extending radially proximate to second end of the tube to vent propellant gases from the expansion volume and moderate pressures and temperatures within the expansion volume.

In some additional, alternative, or selectively cumulative embodiments, a noise suppression tube defining a first end and a second end and an inner surface and an interior surface, the first end of the noise suppression tube being connected to the second end of the tube.

In some additional, alternative, or selectively cumulative embodiments, a coupler is disposed to connect the noise suppression tube to the tube, said coupler having a hole to facilitate exit of the bullet from the tube.

In some additional, alternative, or selectively cumulative embodiments, the end cap is disposed at the second end of the noise suppression tube wherein the end cap defines an outlet opening adapted to be arranged coaxially to the noise suppression tube to facilitate an exit of the bullet and defines a posterior surface.

In some additional, alternative, or selectively cumulative embodiments, a shield baffle is disposed between the first end and second end of the noise suppression tube.

In some additional, alternative, or selectively cumulative embodiments, an auxiliary expansion chamber within the noise suppression tube is disposed between the first end of the noise suppression tube and the shield baffle.

In some additional, alternative, or selectively cumulative embodiments, a suppression chamber within the noise suppression tube is disposed between the shield baffle and the end cap.

In some additional, alternative, or selectively cumulative embodiments, orifices are disposed proximate to the first end of the noise suppression tube to vent high pressure propellant gases from the auxiliary expansion volume thus moderating peak propellant pressures and temperatures.

In some additional, alternative, or selectively cumulative embodiments, within the suppression chamber of the suppression tube is disposed an elastomeric baffle assembly without a hole for the bullet. When the rifle is fired, the bullet makes its own hole as it passes through.

In some additional, alternative, or selectively cumulative embodiments, within the suppression chamber of the suppression tube is disposed a resin impregnated fabric baffle assembly without a hole for the bullet. When the rifle is fired, the bullet makes its own hole as it passes through.

In an additional, alternative, or selective cumulative embodiment and given the thermodynamic processes within the tube in expelling propellant gases through the port(s), orifice(s) and aperture(s) the tube temperature remains low enough to allow the tube to be grasped and thereby allowing the tube to function as the handguard for the rifle.

Wherein propellant gases generated during firing of a bullet exits a muzzle of the barrel and expand inside the expansion volume and the auxiliary expansion volume and enter the suppression chamber and exit the suppressor assembly via the at least one port, the at least one aperture, the at least one orifice and the outlet opening.

Additional aspects and advantages will be apparent from the following detailed description of example embodiments, which proceeds with reference to the accompanying drawings.

DETAILED DESCRIPTION

Figure 1:
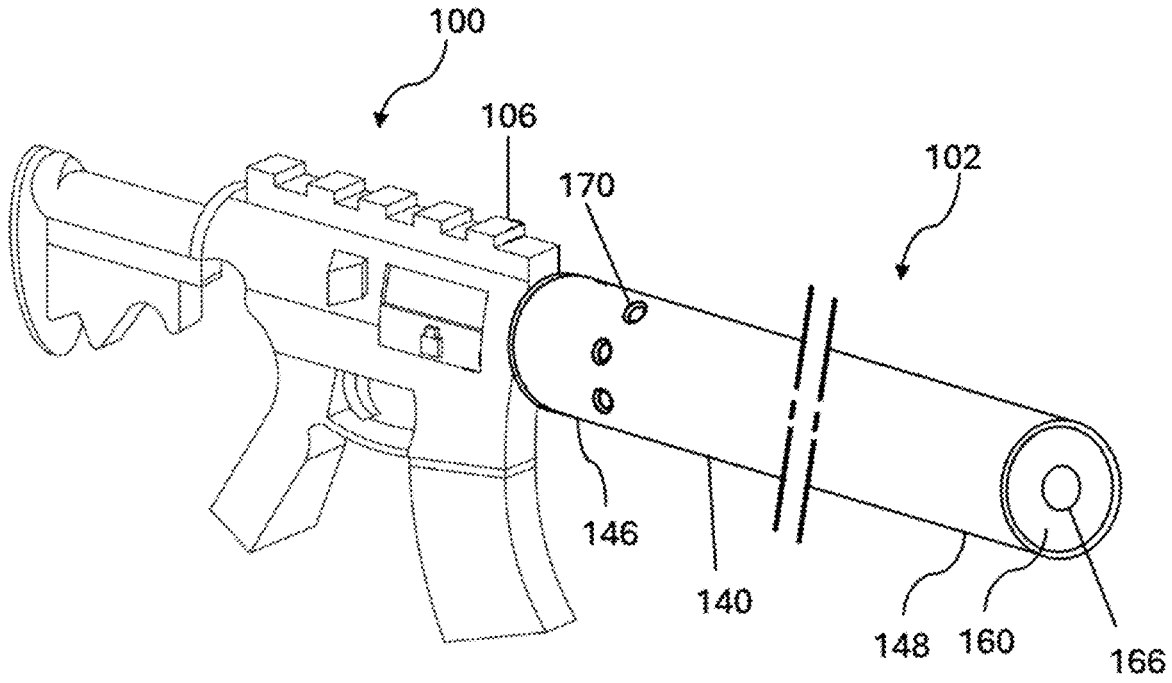
PRIOR ART FIG. 1
FIG. 1 illustrates a perspective view of an example of a firearm assembled with a suppressor in accordance with an embodiment of the '883 Patent.

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing particular example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc. mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

FIG. 1 shows an isometric exterior view of a suppressor 102 assembled to an example firearm 100 in accordance with an embodiment of the '883 Patent. Suppressor 102 is shown coupled to the receiver 106 of firearm 100. The firearm 100 is shown as ArmaLite™ Rifle. However, the firearm 100 may be any other gun or rifle known in the art. In accordance with embodiments of the '883 Patent, suppressor 102 comprises tube 140 with a first end 146 and a second end 148, wherein the first end 146 is coupled to the receiver 106. Tube 140 is cantilevered from the receiver 106 and circumferentially encompasses the barrel (not visible in this view). Disposed in juxtaposition at the first end 146 of tube 140 is defined at least one port or ports 170, extending in a radial direction from the tube 140 to enable an exit for the propellant gases from the interior of the tube 140. Disposed at the second end 148 of the tube 140 is an end cap 160 to close the axial opening of the tube 140, with an outlet opening 166 that provides a means for the bullet to exit suppressor 102.

Figure 2:
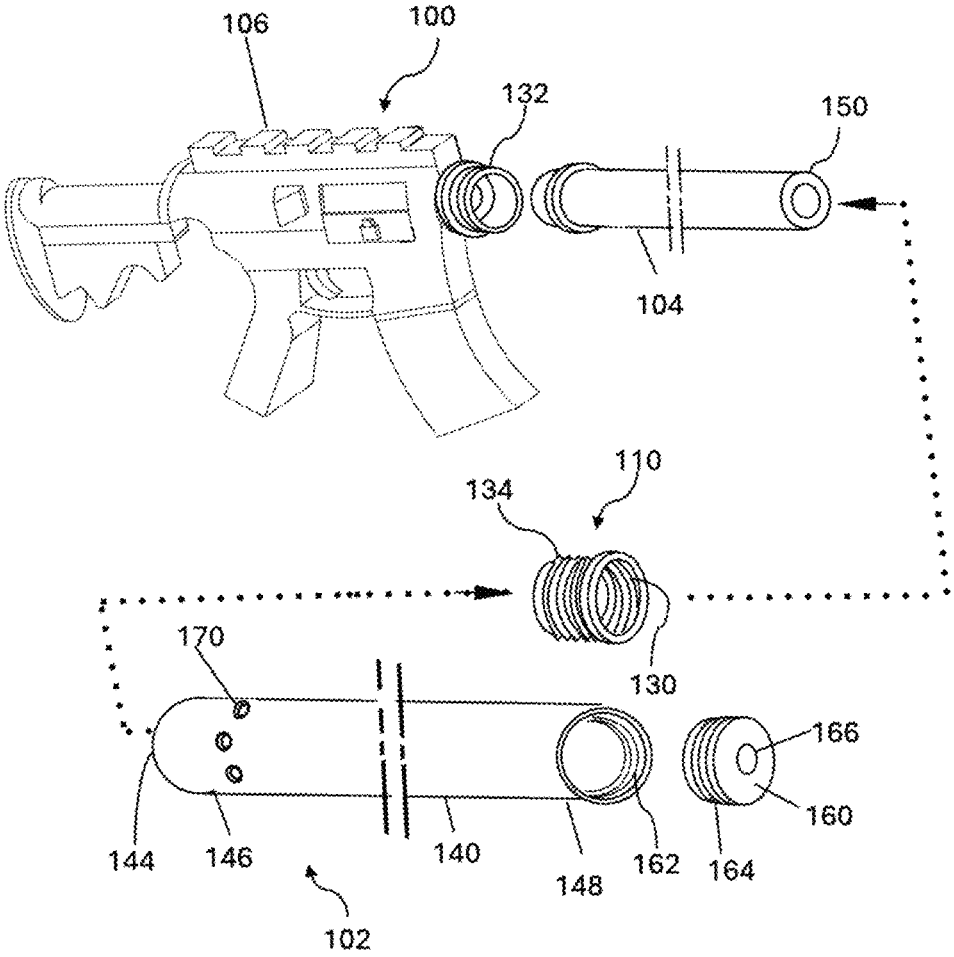
PRIOR ART FIG. 2
FIG. 2 illustrates an isometric and disassembled view of the firearm with a suppressor in accordance with an embodiment of the '883 Patent.

Referring to FIG. 2, an isometric disassembled view of the various components of suppressor 102 assembled to firearm 100, is shown in accordance with an embodiment of the '883 Patent. New elements exposed by this disassembled isometric view are presented. Firearm 100 includes a barrel 104 and a receiver 106, with the barrel 104 having a muzzle end 150, and is coupled to and cantilevered from receiver 106. The connection of barrel 104 to the receiver 106 is facilitated by an embodiment of adapter 110 whose internal threads 130 engage the external threads 132 on the receiver 106 clamping the barrel 104 into the receiver 106 and allowing barrel 104 to extend outwardly of receiver 106 unencumbered. The adapter 110 also facilitates the coupling/engagement of tube 140 of suppressor 102 with the receiver 106 through use of external threads 134 that engage with the internal threads 144 (not visible in this view) of the tube 140. In addition, for this embodiment, end cap 160 with an outlet opening 166 for the bullet is disposed at, and coupled to, the second end 148 of the tube 140 as facilitated by the engagement of the internal threaded portion 162 of the tube 140 with the external threads 164 of the end cap 160. Additional detail of the elements of the '883 Patent are discussed the cross-section view presented on FIG. 8.

Figure 3:
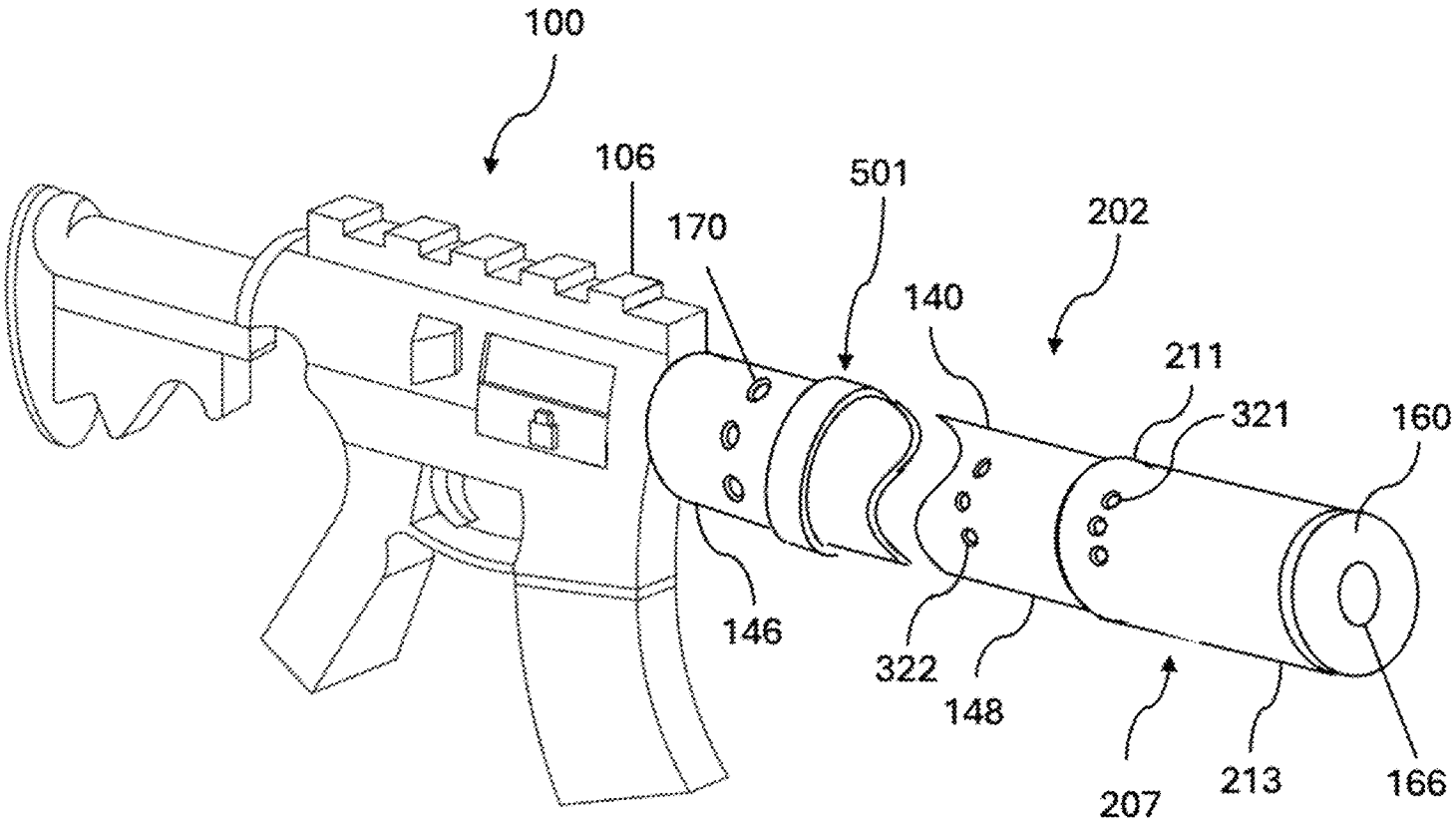
FIG. 3. illustrates a perspective view of an example of a firearm assembled with a suppressor in accordance with an embodiment of the disclosure.

FIG. 3 provides an isometric exterior view of the improved suppressor 202 assembled to an example firearm 100 in accordance with an embodiment of the disclosure. The firearm 100 is shown as ArmaLite™ Rifle. However, the firearm 100 may be any other gun or rifle known in the art. Retained from the '883 Patent are the receiver 106, the tube 140, the first end 146 of the tube 140, the second end 148 of the tube 140, the ports 170, the end cap 160 and the opening for the bullet 166.

The improved suppressor 202 shown in the embodiment of FIG. 3 now includes a noise suppression tube 207 having a first end 211 and a second end 213. Suppression tube 207 is disposed at the second end 148 of the tube 140 with the first end 211 of the noise suppression tube 207 being coupled to the second end 148 of the tube 140. Also shown are the at least one orifice 321 extending radially (three orifices are shown in the FIG. 3) disposed proximate to the first end 211 of the noise suppression tube 207, the purpose of which are to moderate the high-pressure peaks of the propellant gas within the noise suppression tube 207 when the bullet uncorks the barrel. Also shown in this embodiment is the at least one aperture 322 extending radially (three apertures are shown in FIG. 3) disposed proximate to the second end 148 of tube 140, the purpose of which is to moderate pressure peaks. In addition, end cap 160 with outlet opening 166 is disposed at the second end 213 of the noise suppression tube 207 to close the axial opening of the suppression tube 207.

In addition, as shown in an embodiment of the disclosure in FIG. 3, the improved suppressor 202 includes a modulator 501 disposed proximate to the port or ports 170 that extend in a radial direction from the tube 140 to enable an exit for the propellant gases from the interior volume of the tube 140. Adjustment of modulator 501 over the port or ports 170 blocks the flow area and regulates the gas flow from the at least one port or ports 170, thus changing the gas dynamics of improved suppressor 202 in terms of lowest tube 140 temperatures when the port(s) 170 are fully open to most quiet when fully closed.

Figure 4:
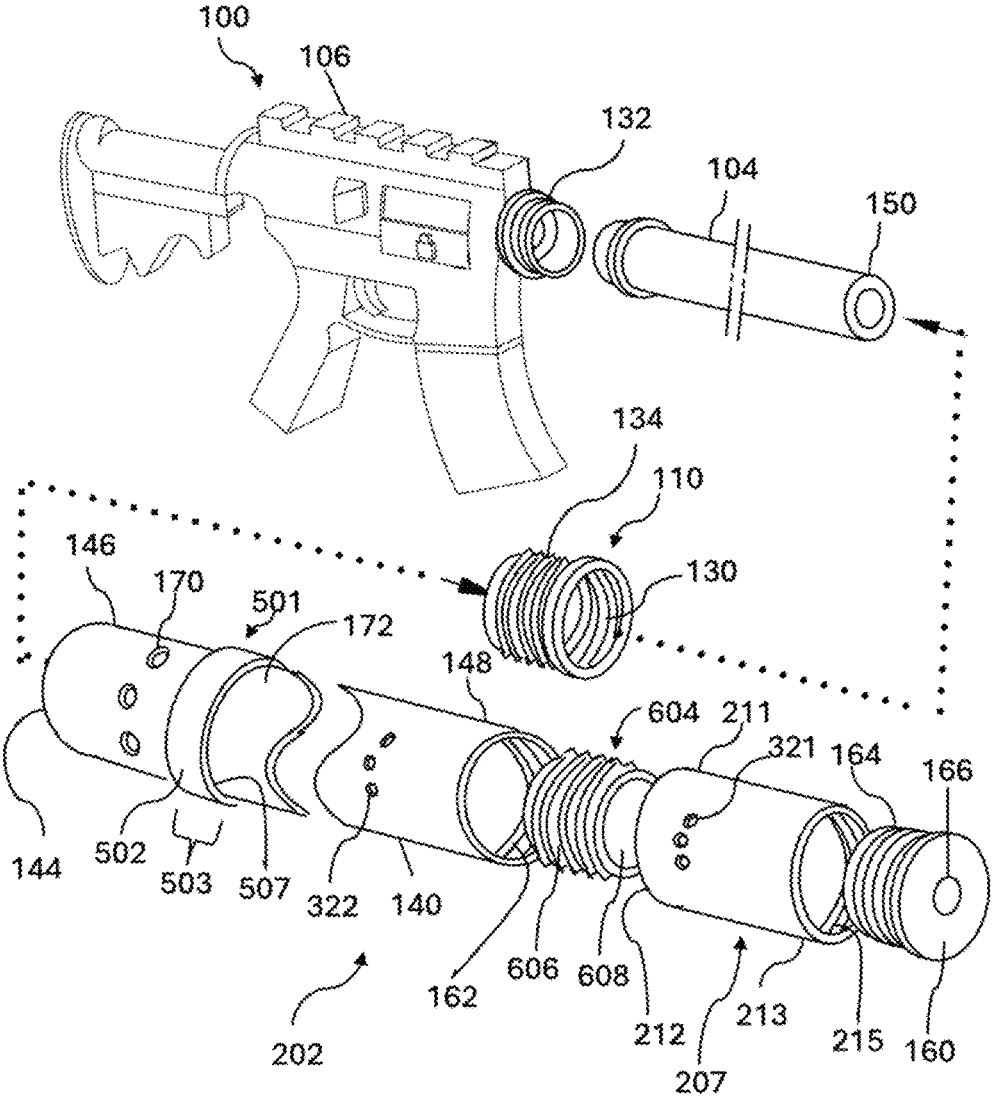
FIG. 4 illustrates an isometric and disassembled view of the firearm with a suppressor in accordance with an embodiment of the disclosure.

Referring to FIG. 4, an isometric and disassembled view of components of an embodiment of the improved suppressor 202 with firearm 100, in accordance with the disclosure, is shown. Now visible in FIG. 4 is an embodiment of the '882 Patent of adapter 110 being retained for use in an embodiment of the disclosure.

Similar to the '883 Patent, tube 140 may be comprised of a structurally rigid material such as alloy steel 4130 or aluminum 7075. However, tube 140 may be made of any other suitable material, such as, but not limited to, other aluminum alloys, or any other suitable material known in the art. In the illustrated embodiment, tube 140 may be configured in a circular shape. However, tube 140 may take any suitable shape, such as triangular, square, hexagonal, or any regular or irregular polygon known in the art.

For this disclosure, noise suppression tube 207 may be comprised of a structurally rigid material such as alloy steel 4130 or aluminum 7075. However, suppression tube may be made of any other suitable material, such as, but not limited to, other aluminum alloys, or any other suitable material known in the art. In the illustrated embodiment, suppression tube 207 may be configured in a circular shape. However, suppression tube 207 may take any suitable shape, such as triangular, square, hexagonal, or any regular or irregular polygon known in the art.

Referring still to FIG. 4, new elements of an embodiment of the disclosure exposed by this disassembled isometric view are disclosed. A coupler 604 is disposed between the tube 140 and the suppression tube 207 to enable connecting or disconnecting suppression tube 207 to tube 140. As shown in FIG. 4, coupling is facilitated by external threads 606 disposed on the exterior of coupler 604 which engage the internal threads 162 disposed on the interior of the second end 148 of the tube 140. Conversely, external threads 606 also facilitate engagement with the internal threads 212 (not shown in this view) disposed on interior of the first end 211 of the suppression tube 207. A hole 608, with a diameter larger than the diameter of bullet, is disposed in the center of the coupler 604 to allow egress of the bullet from tube 140. To those familiar with the art, coupler 604 may be configured as, but not limited to, a quick release device, and may be fabricated from an aluminum or steel alloy, or any other suitable material.

In addition, FIG. 4 depicts an embodiment in accordance with the disclosure of modulator 501 which comprises a ring 502 which extends circumferentially around outer surface 172 of tube 140 and having a width 503 greater than the diameter of port or ports 170. Modulator 501 defines a mating surface 507 (not shown in this view), having clearance between itself and the outer surface 172 of the tube 140 to enable the modulator 501 to be positioned along the outer surface 172 of the tube 140. In another embodiment to those familiar with the art, modulator 501 may be clamped to outer surface 172 of the tube 140. By incrementally adjusting the modulator 501 along the outer surface 172 of the tube 140, the flow area of port or ports 170 can be from fully closed to fully open. In some embodiments, the modulator 501 may be comprised of a structurally rigid material such as alloy steel or aluminum, or any other suitable material known to the art, such as but not limited to, a rubber sleeve given the propellant gas pressures within tube 140 are relatively low. Also, the modulator 501 can regulate the gas flow from port 170 by alternate embodiments known to those skilled in the art, such as but not limited to, a modulator 501 based on rotation of the ring around the outer surface 172 of the tube 140 to obstruct port or ports 170.

Additionally, FIG. 4 depicts an embodiment, in accordance with the disclosure, use of end cap 160, similar to the '883 Patent, to close the axial opening at the second end 213 of the noise suppression tube 207, said end cap 160 having an outlet opening 166 to allow exit of the bullet from improved suppressor 202. Coupling of end cap 160 to the suppression tube 207 is facilitated by external threads 164 on the exterior of the end cap 160 engaging the internal threads 215 on the second end 213 of the suppression tube 207. In an embodiment, the end cap 160 may fabricated from a non-metallic, acoustically dampened material, such as, but not limited to, Nylon 6/6. However, the end cap 160 may be fabricated from any other suitable material available in the art.

Still referring to FIG. 4, in accordance with an embodiment of the disclosure, are shown the at least one orifice 321 (three orifices are shown in the FIG. 4), disposed proximate to the first end 211 of the noise suppression tube 207 the purpose of which is to moderate the high-pressure peaks of the propellant gas when the bullet uncorks the barrel.

Figure 5:
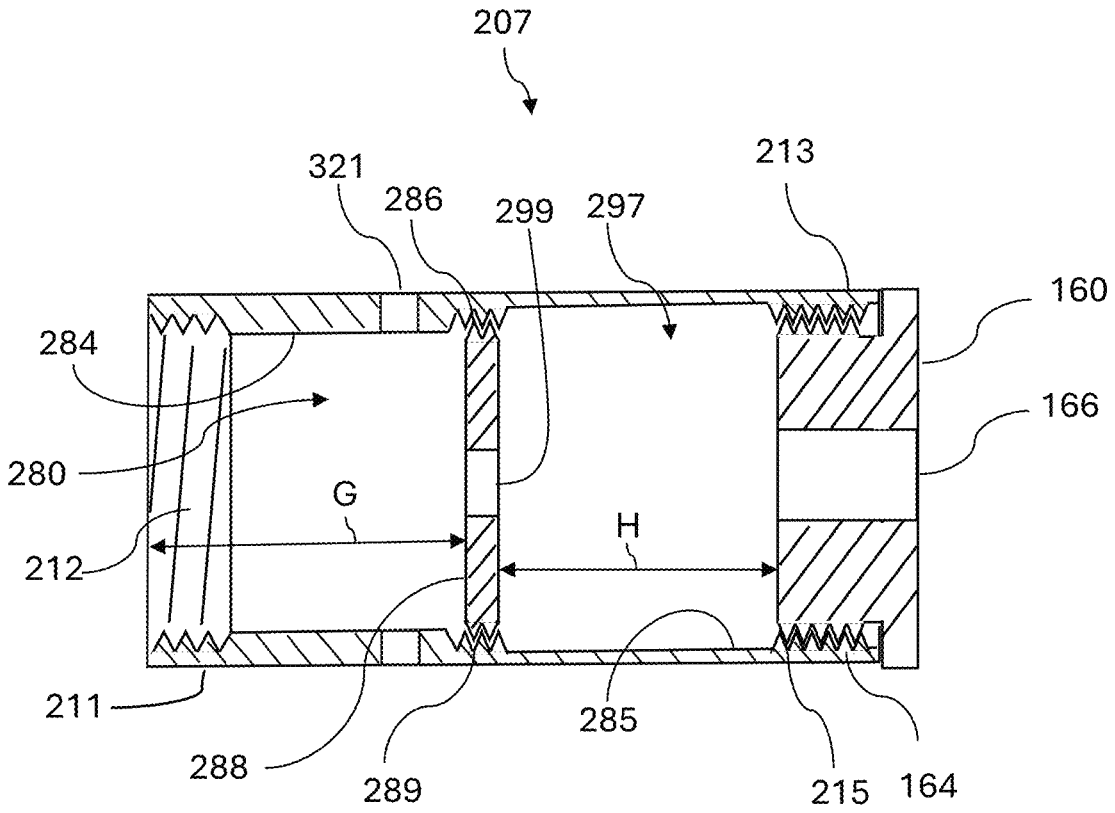
FIG. 5 shows a sectional view of the noise suppression tube in accordance with an embodiment of the disclosure.

Referring to FIG. 5, in accordance with an embodiment of the disclosure, a sectional view of suppression tube 207 is shown. Between the first end 211 and second end 213 of the noise suppression tube 207 is disposed shield baffle 288. Shield baffle 288 may be fabricated from, but not limited to, for example, high strength aluminum alloy like 7075 or high strength steel alloy like 4130. Shield baffle 288 is axially affixed by threaded engagement of internal threads 289 disposed on the interior surface 285 of noise suppression tube 207 with external threads 286 disposed on the edges or outer circumference of shield baffle 288. Shield baffle 288 defines a preformed hole 299 to allow passage of the bullet. The purpose of the shield baffle 288 being to shield suppression components downstream of the shield baffle 288 from the hot gas and impulse loads from the propellant gas flow. To those skilled in the art, other embodiments to affix the shield baffle 288 within the noise suppression tube 207 may be employed.

Still referring to FIG. 5, in accordance with an embodiment of the disclosure, shield baffle 288 is displaced axially in a longitudinal direction from the first end 211 towards the second end 213 of the noise suppression tube 207 as defined by the first axial gap 'G'. Auxiliary expansion volume 280 is disposed within the noise suppression tube 207 and is defined by the first axial gap 'G' and the interior surface 284 of the noise suppression tube 207. The end cap 160 is displaced axially in a longitudinal direction away from the shield baffle 288 towards the second end 213 of the noise suppression tube 207 as defined by the second axial gap 'H'. Suppression chamber 297 is disposed within the noise suppression tube and is defined by the second axial gap 'H' and the inner surface 285 of the noise suppression tube 207.

To those skilled in the art, suppression chamber 297 provides an opportunity to employ a variety of noise suppression technologies such as conical baffles, flat baffles or elastomeric baffles of their choosing within suppression chamber 297.

Moreover, in some embodiments, noise suppression tube 207 may be comprised of a structurally rigid, high strength material such as alloy steel 4130 or aluminum 7075. However, noise suppression tube 207 may be made of any other suitable material, such as, but not limited to, aluminum, cast steel, metal, alloy, or any other suitable material known to the art. In the illustrated embodiments of the FIG's, noise suppression tube 207 may be configured in a circular shape. However, noise suppression tube 207 may take any suitable shape, such as triangular, square, hexagonal or any regular or irregular polygon known in the art.

In the foregoing, in accordance with embodiments of this disclosure, three baffle assemblies which share structural similarity, which are disposed similarly within the noise suppression tube 207, and which perform the same function to suppress noise from the improved suppressor 202, are disclosed.

Referring to FIG. 6, an embodiment of the improved suppressor 202 in accordance with the disclosure, a sectional view and an isometric view of an elastomeric baffle assembly 300 disposed within suppression chamber 297 of noise suppression tube 207 is disclosed. Elastomeric baffle assembly 300 is comprised of a plurality of elastomeric elements 302 without a preformed hole for the bullet being separated by spacers 304 with a hole 303 for the bullet.

Figure 6A:
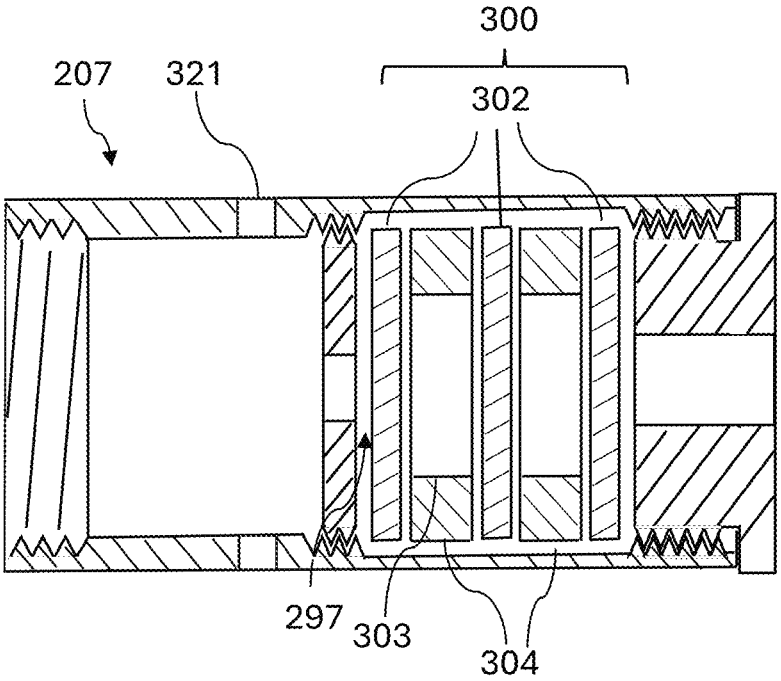
FIG. 6 illustrates a sectional and isometric view of the elastomeric baffle assembly disposed within the noise suppression tube in accordance with an embodiment of the disclosure.

FIG. 6A discloses a sectional view of the arrangement of an embodiment of an elastomeric baffle assembly 300 shown disposed within the suppression chamber 297 of noise suppression tube 207. The assembly 300 is comprised of three elastomeric elements 302 each without a preformed hole for the bullet, being separated by two spacers 304, each with a preformed hole 303 for the bullet. The edges of each elastomeric element 302 being disposed proximate to the inner surface 285 of the noise suppression tube 207 (best seen in FIG. 5).

Figure 6B:
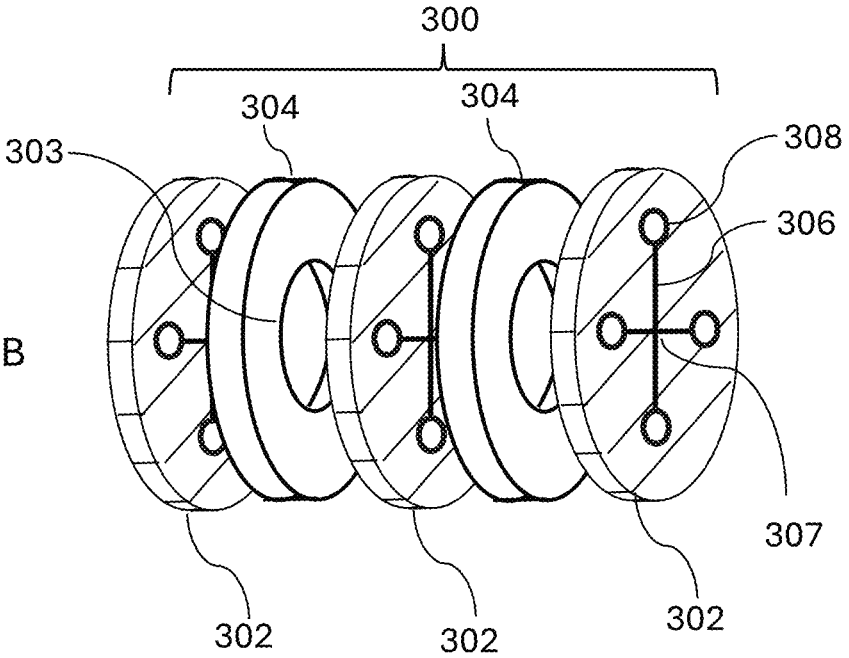

FIG. 6B provides the above embodiment showing an isometric view of the arrangement of components for elastomeric baffle assembly 300. This arrangement discloses three elastomeric elements 302, each without a preformed hole for the bullet, separated by two spacers 304, each spacer 304 having a preformed hole 303 for the bullet. The elastomeric element 302 may be fabricated from, but not limited to, for example, 80 Durometer Polyurethane ⅛ inch thick sheet. In the embodiment disclosed in FIG. 6B, at least two slits 306 are made through the thickness of each elastomeric element 302, the slits 306 intersecting at the center 307 of the elastomeric element 302. Holes 308 that penetrate the thickness of elastomeric element 302 are disposed at each end of each slit 306 to prevent growth in the length of the slits 306 from repeated bullet strikes. During testing, no anomalous crack generation in elastomeric elements 302 was evident.

In accordance with an embodiment of the disclosure, spacers 304 may be fabricated from, for example but not limited to, a metallic material or a non-metallic material such as polyethylene or nylon6/6. The edges of each the spacers 304 being proximate to the inner surface 285 of the noise suppression tube 207.

Referring to FIG. 7, another embodiment of the improved suppressor 202 in accordance with the disclosure, discloses a sectional view and isometric view of a resin impregnated fabric baffle assembly 400 disposed within suppression chamber 297 of noise suppression tube 207. Resin impregnated fabric baffle assembly 400 is comprised of plurality of resin impregnated fabric elements 402 further defined as each element being comprised of at least one layer of a resin impregnated fabric 401 without a preformed hole for the bullet, the resin impregnated fabric elements 402 being separated by spacers 404 with a hole 403 for the bullet.

Figure 7A:
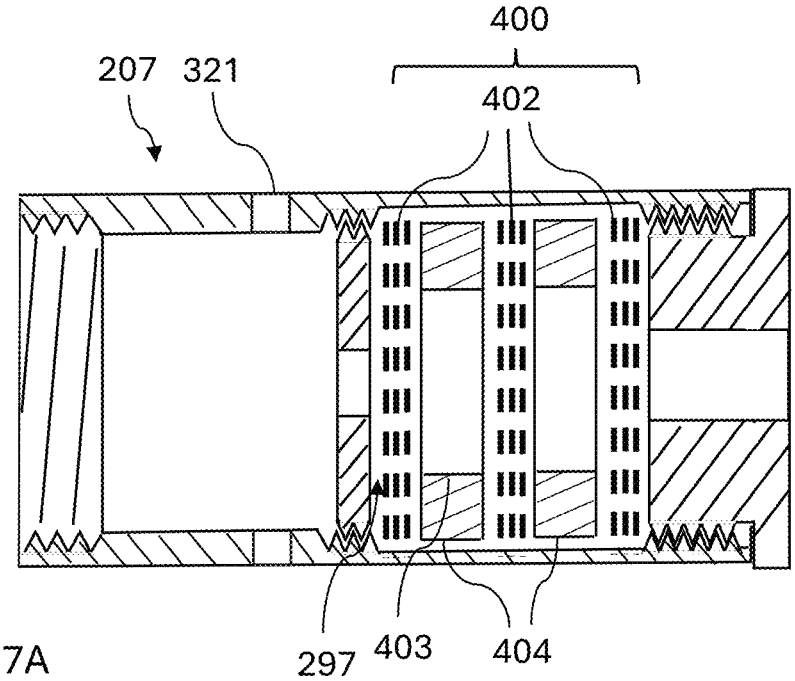
FIG. 7 illustrates a sectional and isometric view of a fabric baffle assembly disposed within the noise suppression tube in accordance with an embodiment of the disclosure.

FIG. 7A discloses a sectional view of the arrangement of an embodiment of a resin impregnated fabric baffle assembly 400 shown disposed within the suppression chamber 297 of noise suppression tube 207. The assembly 400 is comprised of three resin impregnated fabric elements 402, each without a preformed hole for the bullet, being separated by two spacers 404, each with a preformed hole 403 for the bullet. The edges of the resin impregnated fabric elements 402 being disposed proximate to the inner surface 285 of the noise suppression tube 207 (best seen in FIG. 5).

Figure 7B:
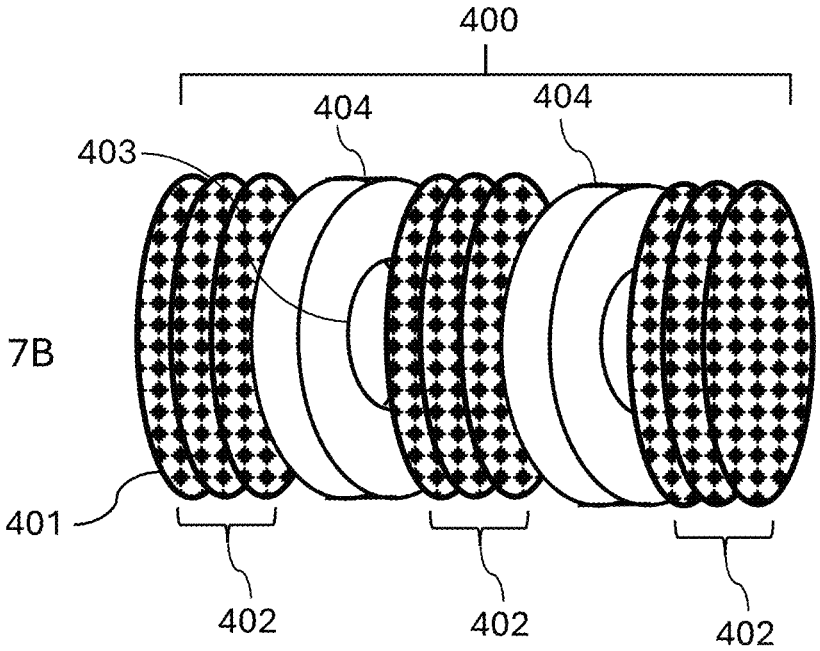

FIG. 7B provides an isometric view of the above embodiment showing the arrangement of components for the resin impregnated fabric baffle assembly 400. This arrangement discloses three resin impregnated fabric elements 402, each element 402 comprised of three layers of resin impregnated fabric 401 and each without a preformed hole for the bullet, separated by two spacers 404, each spacer 404 having disposed a hole 403 for the bullet. Each resin impregnated fabric element 402 is comprised of at least one layer of Kevlar™ fabric 401 (Kevlar™ is a synthetic fiber sold by Dupont Safety and Construction, Inc) and each element being impregnated with a flexible Polyurethane casting compound to minimize fraying caused by repeated bullet strikes. FIG. 7B shows each element 402 comprised of three layers of fabric 401. The resin impregnated fabric elements 402 may be fabricated from a fabric 401 such as, but not limited to, 17 ounce per square yard plain weave Kevlar™ fabric impregnated with a Polyurethane casting resin such as Specialty Resin Chemical (SRC) 40-A durometer Flex-It 40.

In accordance with an embodiment of the disclosure, spacers 404 may be fabricated, for example but not limited to, a metallic material or a non-metallic material such as polyethylene or nylon6/6. The edges of the spacers 404 being proximate to the inner surface 285 of the noise suppression tube 207.

An alternate embodiment (not shown) is disclosed wherein a plurality of resin impregnated fabric elements 402 comprised of at least one layer of resin impregnated fabric 401 are stacked together without separating spacers 404 and are disposed within the suppression chamber 297 of the noise suppression tube 207.

Figure 8:
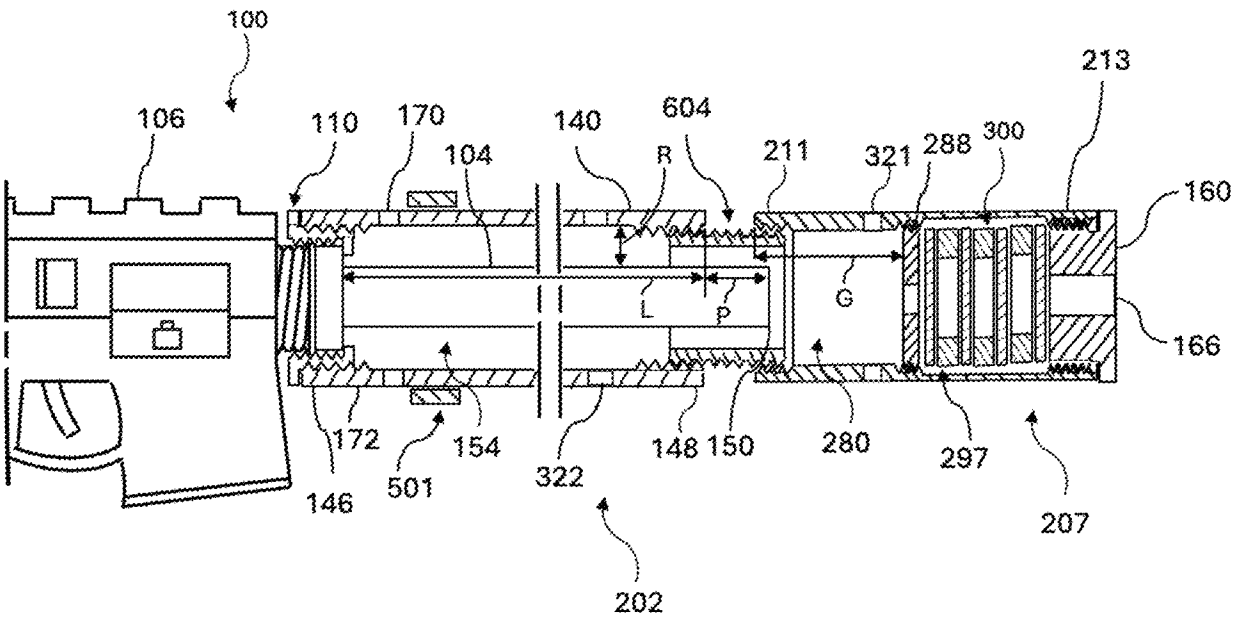
FIG. 8 shows a sectional view of the suppressor assembly in accordance with an embodiment of the disclosure; and, FIG. 9 illustrates a perspective view of another firearm assembled with the suppressor assembly in accordance with an embodiment of the disclosure.

FIG. 8, in accordance with an example embodiment of the disclosure, shows a sectional view of improved suppressor 202 assembled with firearm 100 displaying the arrangement of elements from the '883 Patent wherein: adapter 110 couples the first end 146 of the tube 140 to the receiver 106 of firearm 100; tube 140 encapsulates the barrel 104 and extends axially towards the muzzle end 150 of firearm 100; and, at least one port or ports 170 extending radially outward are disposed proximate to first end 146 and at least one aperture or apertures 322 extending radially outward are disposed proximate the second end 148 of tube 140. Modulator 501 is shown proximate to the at least one port 170 or ports.

As shown in FIG. 8, the dimensions of the tube 140 are greater than the outer diameter of the barrel 104, defining radial gap 'R' therebetween. As shown in the embodiment of FIG. 8, the muzzle 150 of the barrel 104 extends beyond the second end 148 of the tube 140 a distance defined by a protrusion 'P' therebetween. In the '883 patent embodiments, the tube 140 is configured to extend outwardly of the barrel 104 in a longitudinal direction defining an axial gap therebetween the radial gap 'R' and the axial gap together defining the expansion volume around the barrel 104. In the embodiments of this disclosure the barrel 104 extends beyond the second end 148 of the tube 140 by the protrusion 'P'. Tube 140 terminates short of the muzzle 150 of the barrel 104, defining a length 'L' of tube 140 as defined as the distance from the juncture of tube 140 with the receiver 106 to the second end 148 of tube 140. The combination of length 'L' and radial gap 'R' together define the expansion volume 154 around the barrel 104.

Moreover, in some embodiments, tube 140 may be comprised of a structurally rigid, high strength material such as alloy steel 4130 or aluminum 7075. However, tube 140 may be made of any other suitable material, such as, but not limited to, aluminum, cast steel, metal, alloy, or any other suitable material known to the art. In the illustrated embodiments of the FIG's, tube 140 may be configured in a circular shape. However, tube 140 may take any suitable shape, such as triangular, square, hexagonal or any regular or irregular polygon known in the art.

Also shown in FIG. 8 as an embodiment of the disclosure wherein: at the second end 148 of the tube 140 is disposed the noise suppression tube 207. Coupler 604 is disposed to connect suppression tube 207 to tube 140; engagement of coupler 604 to the second end 148 of tube 140 and the first end 211 of the noise suppression tube 207 is facilitated by mating threads on all interfacing surfaces; noise suppression tube 207 is shown slightly unthreaded from tube 140 for clarity.

As shown in FIG. 8 as an embodiment of the disclosure is disclosed shield baffle 288 disposed a distance 'G' away from the first end 211 of the noise suppression tube 207. Distance 'G' being several inches greater than protrusion 'P' to define auxiliary expansion volume 280. As appreciated by those skilled in the art, alternate embodiments may define the termination of second end 148 of tube 140 several inches beyond the muzzle 150 with the distance 'G' being adjusted accordingly to maintain the auxiliary expansion volume 280 or to allow engagement of coupler 604 with the noise suppression tube 207. Disposed at the second end 213 of the noise suppression tube 207 is end cap 160 defining an outlet opening 166 for the bullet. Within suppression chamber 297 (best seen in FIG. 5) is disposed elastomeric baffle assembly 300.

During firing of the rifle, propellant gases generated during firing of the firearm exit a muzzle 150 of the barrel 104 and expand inside the expansion volume 154 and enter the auxiliary expansion volume 280 and the suppression chamber 297 wherein a baffle assembly retards the gas flow, and the gases exit the suppressor assembly via the at least one port 170, the at least one aperture 322, the at least one orifice 321 and the outlet opening 166.

The instant inventor discovered during testing of a prototype of an embodiment of this disclosure, that the improved suppressor 202 did not get too hot to the grasp even after repetitive firing of the weapon wherein the temperature of tube 140, where grasped near receiver 106, did not exceed 135 degrees Fahrenheit. This is due to the expansion volumes and the thermodynamic process that occurs when the propellant gases are expelled through the various port(s) 170 and orifice(s) 321 and aperture(s) 322. Thus, the tube 140 can serve as the handguard for the firearm.

FIG. 9 illustrates a firearm 700 according to an alternative embodiment. The firearm 700 shown is that of a Remington Model 700 rifle with a shortened forearm 708. To those familiar with the state of the art, alternate firearms may be employed. Improved suppressor 202 is coupled to firearm 700 using an adaptor (not shown) that is configured to fit onto firearm 700 in juxtaposition to receiver 706.

An embodiment of the is as follows and captures all the suppressor improvements aforementioned. For an AR series of firearm using a 300 BLK round with 16-inch barrel the following description is provided. The tube is a 2 inch outside diameter cylindrical tube with a 0.125 inches thick wall, 17 inches long and made from aluminum 6061. Six openings 0.375 inches in diameter are drilled through this tube near the receiver to form six ports. Six apertures and six orifices were formed by drilling 0.125 diameter holes in the tube. The modulator is an aluminum split ring that clamps onto the tube. The suppression tube is a 2 inch outside diameter cylindrical tube with a 0.125 inches thick wall, 4.5 inches long and made from aluminum 6061. The end cap is made from aluminum and is pressed into place. Inside the noise suppression tube is an elastomeric baffle assembly. The adapter and the coupler were fabricated from a commercial barrel nut for the AR firearm.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims.

What is claimed is:

1. A suppressor assembly for a firearm having a receiver and a barrel connected to the receiver, the suppressor assembly comprising:

a tube having a length defined between a first end and a second end of the tube, wherein the first end of the tube is adapted to be coupled to the receiver, wherein the tube is configured to be arranged around the barrel to define a radial gap therebetween, and wherein the radial gap and the length of the tube together are configured to define an expansion volume around the barrel;

at least one port arranged proximate to the first end of the tube and extending radially through the tube;

an adapter with a body and flange portion, wherein the adapter is configured to couple the first end of the tube to the receiver;

a noise suppression tube having a first end and a second end, wherein the first end of the noise suppression tube is adapted to couple to the second end of the tube;

an end cap coupled to the second end of the noise suppression tube, wherein the end cap defines an outlet opening adapted to be arranged coaxially to the barrel to facilitate an exit of a bullet from the tube;

at least one orifice disposed proximate to the first end of the noise suppression tube and extending radially; and a shield baffle axially disposed between the first end and the second end of the noise suppression tube, wherein the shield baffle defines a preformed hole arranged coaxially to the noise suppression tube to facilitate passage of the bullet;

wherein propellant gases generated during firing of the bullet exit a muzzle of the barrel, expand inside the expansion volume, and exit the tube through the at least one port; and wherein the tube is adapted to serve as a handguard for the firearm.

2. The suppressor assembly of claim 1, further including at least one aperture disposed proximate to the second end of the tube and extending radially.

3. The suppressor assembly of claim 1, further including an auxiliary expansion volume disposed within the noise suppression tube between the shield baffle and the first end of the noise suppression tube.

4. The suppressor assembly of claim 1, further including a suppression chamber disposed within the noise suppression tube between the shield baffle and the end cap.

5. The suppressor assembly of claim 1, further including a coupler disposed at the second end of the tube to enable coupling of the first end of the noise suppression tube to the second end of the tube.

6. The suppressor assembly of claim 1, further including a modulator disposed on an outer surface of the tube in juxtaposition to the at least one port to modulate a flow of the propellant gases exiting the tube from the at least one port.

7. The suppressor assembly of claim 1, further including a suppression chamber disposed within the noise suppression tube between the shield baffle and the end cap; and a baffle assembly disposed within the suppression chamber and comprising:

an elastomeric baffle assembly comprising a plurality of elastomeric elements, wherein each of the elastomeric elements includes at least one slit disposed through a thickness thereof, a hole disposed through the thickness thereof at each end of the slit, and without a preformed hole therethrough for the bullet, and wherein each of the elastomeric elements are separated from one another by a spacer with a hole therethrough for the bullet;

a resin impregnated fabric baffle assembly comprising a plurality of resin impregnated fabric elements, wherein each of the fabric elements includes at least one layer of a resin impregnated fabric without a preformed hole for the bullet, and wherein each of the fabric elements are separated from one another by a spacer with a hole therethrough for the bullet; or a resin impregnated fabric baffle assembly comprising a plurality of resin impregnated fabric elements, wherein each of the fabric elements includes at least one layer of a resin impregnated fabric without a preformed hole for the bullet, and wherein each of the fabric elements are stacked together without separating spacers therebetween.

8. The suppressor assembly of claim 1, wherein the propellant gases generated during the firing of the bullet exit the muzzle of the barrel, expand inside the expansion volume, expand inside the auxiliary expansion volume, enter a suppression chamber disposed within the noise suppression tube between the shield baffle and the end cap, and exit the tube and the noise suppression tube via the at least one port, the at least one orifice, the outlet opening, and at least one aperture disposed proximate to the second end of the tube and extending radially.

9. A firearm comprising:

a receiver;

a barrel connected to the receiver; and a suppressor assembly, comprising:

a tube having a length defined between a first end and a second end of the tube, wherein the first end of the tube is adapted to be coupled to the receiver, wherein the tube is configured to be arranged around the barrel to define a radial gap therebetween, and wherein the radial gap and the length of the tube together are configured to define an expansion volume around the barrel;

at least one port arranged proximate to the first end of the tube and extending radially;

an adapter with a body and flange portion, wherein the adapter is configured to couple the first end of the tube to the receiver;

a noise suppression tube having a first end and a second end, wherein the first end of the noise suppression tube is adapted to couple to the second end of the tube;

an end cap coupled to the second end of the noise suppression tube, wherein the end cap defines an outlet opening adapted to be arranged coaxially to the barrel to facilitate an exit of a bullet from the tube;

at least one orifice disposed proximate to the first end of the noise suppression tube and extending radially; and a shield baffle axially disposed between the first end and the second end of the noise suppression tube, wherein the shield baffle defines a preformed hole arranged coaxially to the noise suppression tube to facilitate passage of the bullet;

wherein propellant gases generated during firing of the bullet exit a muzzle of the barrel, expand inside the expansion volume, and exit the tube through the at least one port; and wherein the tube is adapted to serve as a handguard for the firearm.

10. The firearm of claim 9, further including at least one aperture disposed proximate to the second end of the tube and extending radially.

11. The firearm of claim 9, further including an auxiliary expansion volume disposed within the noise suppression tube between the shield baffle and the first end of the noise suppression tube.

12. The firearm of claim 9, further including a suppression chamber disposed within the noise suppression tube between the shield baffle and the end cap.

13. The firearm of claim 9, further including a coupler disposed at the second end of the tube to enable coupling of the first end of the noise suppression tube to the second end of the tube.

14. The firearm of claim 9, further including a modulator disposed on an outer surface of the tube in juxtaposition to the at least one port to modulate a flow of the propellant gases exiting the tube from the at least one port.

15. The firearm of claim 9, further including a suppression chamber disposed within the noise suppression tube between the shield baffle and the end cap; and a baffle assembly disposed within the suppression chamber and comprising:

an elastomeric baffle assembly comprising a plurality of elastomeric elements, wherein each of the elastomeric elements includes at least one slit disposed through a thickness thereof, a hole disposed through the thickness thereof at each end of the slit, and without a preformed hole therethrough for the bullet, and wherein each of the elastomeric elements are separated from one another by a spacer with a hole therethrough for the bullet;

a resin impregnated fabric baffle assembly comprising a plurality of resin impregnated fabric elements, wherein each of the fabric elements includes at least one layer of a resin impregnated fabric without a preformed hole for the bullet, and wherein each of the fabric elements are separated from one another by a spacer with a hole therethrough for the bullet; or a resin impregnated fabric baffle assembly comprising a plurality of resin impregnated fabric elements, wherein each of the fabric elements includes at least one layer of a resin impregnated fabric without a preformed hole for the bullet, and wherein each of the fabric elements are stacked together without separating spacers therebetween.

16. The firearm of claim 9, wherein the propellant gases generated during the firing of the bullet exit the muzzle of the barrel, expand inside the expansion volume, expand inside the auxiliary expansion volume, enter a suppression chamber disposed within the noise suppression tube between the shield baffle and the end cap, and exit the tube and the noise suppression tube via the at least one port, the at least one orifice, the outlet opening, and at least one aperture disposed proximate to the second end of the tube and extending radially.

* * * * *